US011810736B1

(12) United States Patent
Yang

(10) Patent No.: US 11,810,736 B1
(45) Date of Patent: Nov. 7, 2023

(54) LIGHT ADJUSTING STRUCTURE

(71) Applicant: Primax Electronics Ltd., Taipei (TW)

(72) Inventor: Yu-Zeng Yang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/957,908

(22) Filed: Sep. 30, 2022

(30) Foreign Application Priority Data

Sep. 7, 2022 (TW) ..... 111133962

(51) Int. Cl.
*H01H 13/83* (2006.01)

(52) U.S. Cl.
CPC ..... *H01H 13/83* (2013.01); *H01H 2219/054* (2013.01)

(58) Field of Classification Search
CPC ..... H01H 3/00; H01H 3/12; H01H 13/00; H01H 13/02; H01H 13/14; H01H 13/50; H01H 13/70; H01H 13/83; H01H 2219/00; H01H 2219/014; H01H 2219/018; H01H 2219/054; H01H 2219/036; H01H 2219/038; H01H 2219/039; H01H 2219/056; H01H 2219/058; H01H 2219/06; H01H 2219/062; H01H 2219/064
USPC ..... 200/314
See application file for complete search history.

(56) References Cited

U.S. PATENT DOCUMENTS 4,449,024 A * 5/1984 Stracener ..... H01H 13/702 362/23.15

* cited by examiner

*Primary Examiner* — Anthony R Jimenez
(74) *Attorney, Agent, or Firm* — KIRTON McCONKIE; Evan R. Witt

(57) ABSTRACT

A light adjusting structure is disposed between a light source in a device and a light exiting surface of the device. The light adjusting structure includes at least one visible light absorbing pattern defining a plurality of light-transmitting regions, and a ratio of a thickness of the at least one visible light absorbing pattern to a width of one of the light-transmitting regions is greater than or equal to 0.5, and a vertical projection of the at least one visible light absorbing pattern presents a checkerboard pattern or a mesh pattern.

15 Claims, 7 Drawing Sheets

LIGHT ADJUSTING STRUCTURE

FIELD OF THE INVENTION

The present invention relates to a light adjusting structure disposed between a light source in a device and a light exiting surface of the device.

BACKGROUND OF THE INVENTION

One of common problems of an illuminated keyboard is that a user's viewing angle is easy to directly see strong light leakage of a backlight source, and intensity of the light leakage is often more than ten times that of a display region. If the user sees the strong light leakage in a dark environment, it will easily cause discomfort. In addition, the light leakage may also be projected onto a device close to the keyboard, causing interference for users. Light leakage or interference of lights of different colors may occur on other electronic devices.

SUMMARY OF THE INVENTION

The present disclosure provides a light adjusting structure disposed between a light source in a device and a light exiting surface of the device. The light adjusting structure includes at least one visible light absorbing pattern defining a plurality of light-transmitting regions, and a ratio of a thickness of the at least one visible light absorbing pattern to a width of one of the light-transmitting regions is greater than or equal to 0.5, and a vertical projection of the at least one visible light absorbing pattern presents a checkerboard pattern or a mesh pattern.

The present disclosure further provides a keyboard device, which includes a plurality of keycaps, a light source, and a light adjusting structure. The light source is disposed beneath the keycaps. The light adjusting structure is disposed between the light source and at least one of the keycaps, in which the light adjusting structure includes at least one visible light absorbing pattern defining a plurality of light-transmitting regions, and a ratio of a thickness of the at least one visible light absorbing pattern to a width of one of the light-transmitting regions is greater than or equal to 0.5, and a vertical projection of the at least one visible light absorbing pattern presents a checkerboard pattern or a mesh pattern.

In some embodiments of the present disclosure, the light source is a backlight module or at least one lamp bead.

In some embodiments of the present disclosure, the light source is the backlight module including a lamp bead and a light guide plate laterally adjacent to the lamp bead, and the light adjusting structure is disposed on the lamp bead and/or the light guide plate.

In some embodiments of the present disclosure, the light source is the backlight module, and the keyboard device further includes: a light-shielding layer, disposed between the keycaps and the light adjusting structure, or disposed between the light adjusting structure and the backlight module.

In some embodiments of the present disclosure, the light source is the at least one lamp bead, and the keyboard device further includes: a base plate, disposed beneath the keycaps, in which the at least one lamp bead is disposed on the base plate, and the light adjusting structure is disposed on the at least one lamp bead.

In some embodiments of the present disclosure, there is a gap between adjacent two of the keycaps, and the vertical projection of the at least one visible light absorbing pattern is overlapped with a vertical projection of the gap.

In some embodiments of the present disclosure, the vertical projection of the at least one visible light absorbing pattern is overlapped with a vertical projection of the at least one of the keycaps.

In some embodiments of the present disclosure, the at least one of the keycaps has a character region and a peripheral region outside the character region, and the vertical projection of the at least one visible light absorbing pattern is overlapped with a vertical projection of the peripheral region and is not overlapped with a vertical projection of the character region.

In some embodiments of the present disclosure, each of the light-transmitting regions is polygonal or circular.

In some embodiments of the present disclosure, the ratio is greater than or equal to 1.

In some embodiments of the present disclosure, the light adjusting structure further includes a substrate, and the at least one visible light absorbing pattern is disposed on an upper surface or a lower surface of the substrate.

In some embodiments of the present disclosure, the light adjusting structure further includes a substrate, and the at least one visible light absorbing pattern is two visible light absorbing patterns respectively disposed on an upper surface and a lower surface of the substrate.

In some embodiments of the present disclosure, each of the two visible light absorbing patterns includes a plurality of strip patterns, and the two vertical projections of the two visible light absorbing patterns present the mesh pattern.

BRIEF DESCRIPTION OF THE DRAWINGS

Aspects of the present disclosure are best understood from the following embodiments, read in conjunction with the accompanying drawings. It should be understood, however, that in accordance with common practice in the industry, various features have not necessarily been drawn to scale. Indeed, shapes of the various features may be suitably adjusted for clarity, and dimensions of the various features may be arbitrarily increased or decreased.

DETAIL DESCRIPTION OF THE PREFERRED EMBODIMENT

Figure 1:
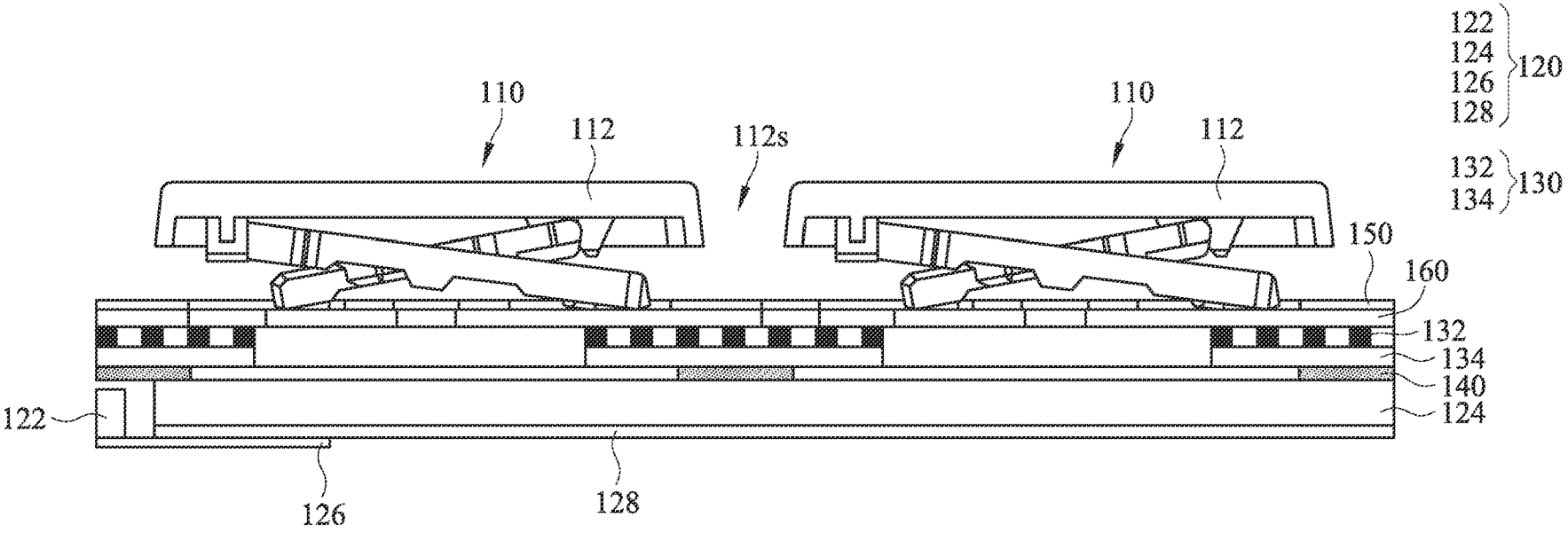
FIG. 1 is a schematic cross-sectional view of a keyboard device according to an embodiment of the present invention.

The advantages and features of the present disclosure and the method for achieving the same will be described in more detail with reference to exemplary embodiments and the accompanying drawings to make it easier to understand. However, the present disclosure can be implemented in different forms and should not be construed as being limited to the embodiments set forth herein. On the contrary, for those skilled in the art, the provided embodiments will make this disclosure more thorough, comprehensive and complete to convey the scope of the present disclosure.

The spatially relative terms in the text, such as "beneath" and "over", are used to facilitate the description of the relative relationship between one element or feature and another element or feature in the drawings. The true meaning of the spatially relative terms includes other orientations. For example, when the drawing is flipped up and down by 180 degrees, the relationship between the one element and the other element may change from "beneath" to "over." In addition, the spatially relative descriptions used herein should be interpreted the same.

As described in the related art, the user can easily directly see the strong light leakage of the backlight source of the illuminated keyboard and may see its projection, thereby causing discomfort and interference to the user. Accordingly, the present invention provides a light adjusting structure including a visible light absorbing pattern, which can be applied to a keyboard device to solve the aforementioned issues. Various embodiments of the keyboard device of the present invention will be described in detail below.

FIG. 1 is a schematic cross-sectional view of a keyboard device according to an embodiment of the present invention. As shown in FIG. 1, the keyboard device includes a plurality of key structures 110, a light source (e.g., a backlight module 120) and a light adjusting structure 130.

In some embodiments, each of the key structures 110 includes a keycap 112. In some embodiments, each of the key structures 110 further includes a scissor-type connecting element (not marked). In some embodiments, each of the key structures 110 further includes an elastic element (not shown). In some embodiments, the keyboard device further includes a membrane circuit board 150 and a base plate 160 located beneath the membrane circuit board 150, and the key structures 110 are disposed over the base plate 160.

The light source (e.g., the backlight module 120) is disposed beneath the keycaps 112. In some embodiments, the backlight module 120 is disposed beneath the base plate 160. In some embodiments, the backlight module 120 is a side-emitting backlight module, which includes a lamp bead 122 and a light guide plate 124 laterally adjacent to the lamp bead 122, and the light adjusting structure 130 is disposed on the lamp bead 122 and/or the light guide plate 124. In some embodiments, the light adjusting structure 130 is in direct or indirect contact with an upper surface of the lamp bead 122 and/or an upper surface of the light guide plate 124. In some embodiments, the backlight module 120 further includes a circuit board 126 (e.g., a flexible printed circuit board (FPCB)) and a reflective layer 128, and the lamp bead 122 and the light guide plate 124 may be respectively disposed on the circuit board 126 and the reflective layer 128. The reflective layer 128 can help improve light utilization. However, the present invention is not limited to the above-mentioned embodiments. In some embodiments, the backlight module is a direct-type backlight module (not shown), which is disposed beneath the key structures, and the backlight module includes a light source substantially aligned with the keycap, and the light adjusting structure is disposed between the light source and the keycap.

The light adjusting structure 130 is disposed between the light source (e.g., the backlight module 120) and at least one of the keycaps 112. In some embodiments, the light adjusting structure 130 is disposed between the backlight module 120 and the base plate 116. The light adjusting structure 130 includes at least one visible light absorbing pattern 132, which defines a plurality of light-transmitting regions (e.g., light-transmitting regions 132*t* shown in FIG. 2). The light-transmitting region 132*t* may be a space or a material with high light transmittance. The visible light absorbing pattern 132 can be opaque or translucent, and its color can be black or another color, so that light transmittance and its color can meet actual requirements. The visible light absorbing pattern 132 can be fabricated by UV imprinting, laser engraving, drilling, or lithography.

In some embodiments, the light adjusting structure 130 further includes a substrate 134, and the visible light absorbing pattern 132 is disposed (or formed) on an upper surface or a lower surface of the substrate 134. The substrate 134 is a transparent substrate, for example, it may be made of a transparent plastic material. In some embodiments, as shown in FIG. 1, the substrate 134 is partially disposed, but the present invention is not limited thereto. In other embodiments, dimensions of the substrate (not shown) may be substantially same as that of the base plate 160 shown in FIG. 1, and the visible light absorbing pattern is disposed over a portion of the substrate. In other embodiments, the light adjusting structure does not include a substrate, and the visible light absorbing pattern is directly formed on a component beneath the keycap, for example, formed on the upper surface of the light guide plate and/or the upper surface of the lamp bead.

In some embodiments, as shown in FIG. 1, the keyboard device further includes a light shielding layer 140 disposed between the light adjusting structure 130 and the backlight module 120. The light shielding layer 140 is substantially aligned with a gap 112*s* between adjacent two of the keycaps 112. In some embodiments, the light shielding layer 140 may be directly formed on the lower surface of the substrate 134. In embodiments where the light adjusting structure does not include the substrate, the visible light absorbing pattern may be directly formed on an upper surface and/or a lower surface of the light shielding layer.

Figure 2:
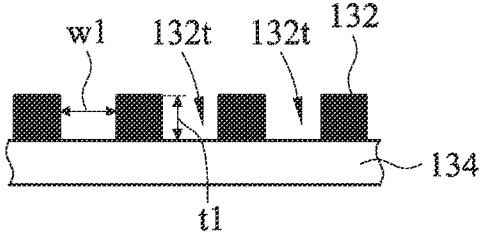
FIG. 2 is a partial schematic cross-sectional view of the light adjusting structure of FIG. 1.

FIG. 2 is a schematic cross-sectional view of the light adjusting structure of FIG. 1. As shown in FIG. 2, the visible light absorbing pattern 132 defines a plurality of light-transmitting regions 132*t*. Specifically, the visible light absorbing pattern 132 is configured to define the light-transmitting regions 132*t* uniformly distributed on a two-dimensional plane and each having a small dimension so as to reduce a light exit angle and a light exit dimension, thereby uniformly reducing light intensity after the light passes through the visible light absorbing pattern 132.

Please continue to refer to FIG. 2, when a thickness t1 of the visible light absorbing pattern 132 is larger, the light exit angle is smaller; when the dimension/area (refer to a width w1 of the light-transmitting region 132*t*) of the light-transmitting region 132*t* at a top viewing angle is smaller, the light exit dimension is smaller. In the case where the light exit angle is smaller and the light exit dimension is smaller, it is more difficult for the user to see the light leakage under an oblique viewing angle. In some embodiments, a ratio of the thickness t1 of the visible light absorbing pattern 132 to the width w1 of the light-transmitting region 132*t* is greater than or equal to 0.5. In some embodiments, the ratio is greater than or equal to 1, that is, the thickness t1 is greater than or equal to the width w1. In some embodiments, the thickness t1 and the width w1 may be appropriately adjusted according to actual needs, for example, between 5 microns and 1,000 microns, such as 10 microns, 20 microns, 30 microns, 40 microns, 50 microns, 60 microns, 70 microns, 80 microns, 90 microns, 100 microns, 200 microns, 300 microns, 400 microns, 500 microns, 600 microns, 700 microns, 800 microns, 900 microns or a value between any two aforementioned values. In some embodiments, the thickness t1 and the width w1 are between 50 microns and 1,000 microns.

In some embodiments, as shown in FIG. 1, a vertical projection of the visible light absorbing pattern 132 is overlapped with a vertical projection of at least one of the keycaps 112. In some embodiments, there is the gap 112*s* between adjacent two of the keycaps 112, and the vertical projection of the visible light absorbing pattern 132 is overlapped with a vertical projection of the gap 112*s*. The overlapping range can be appropriately adjusted according to actual needs to effectively avoid the strong light leakage around the keycap 112.

Figure 3:
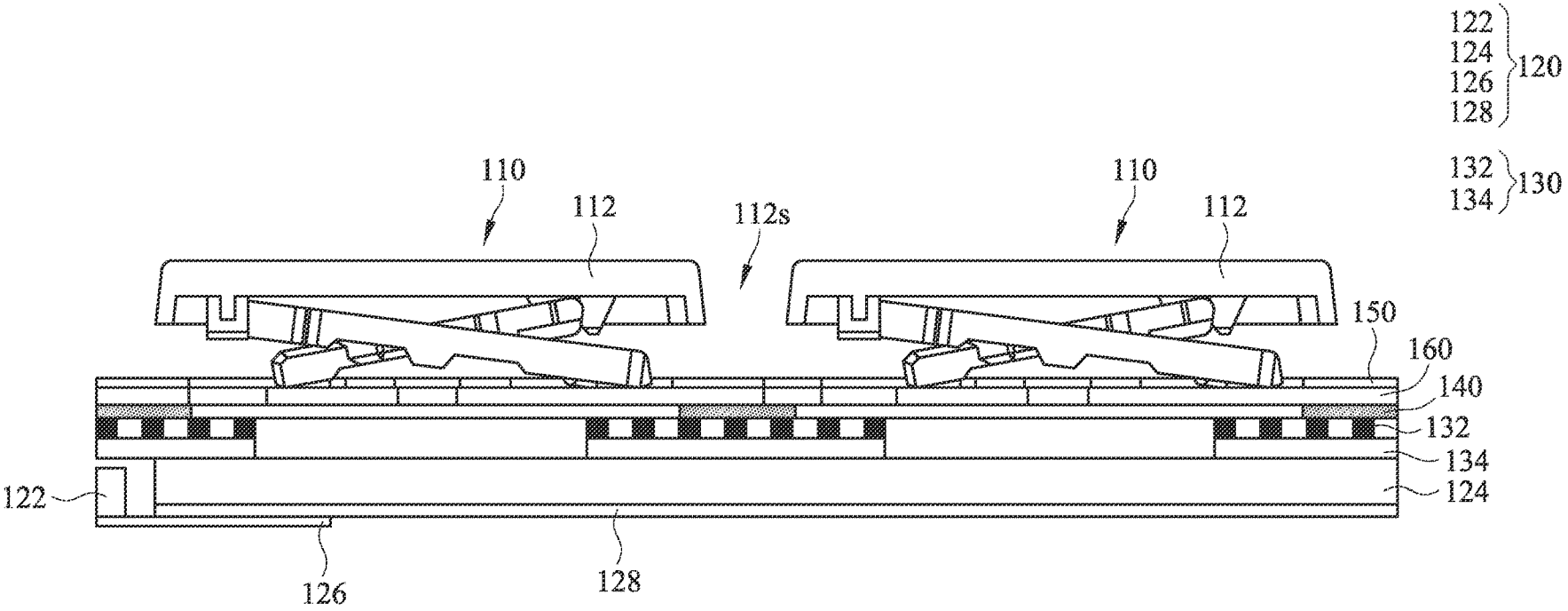
FIG. 3 is a schematic cross-sectional view of a keyboard device according to an embodiment of the present invention.

FIG. 3 is a schematic cross-sectional view of a keyboard device according to an embodiment of the present invention. The difference between FIG. 3 and FIG. 1 is that the light shielding layer 140 is disposed between the keycaps 112 and the light adjusting structure 130.

Figure 5:
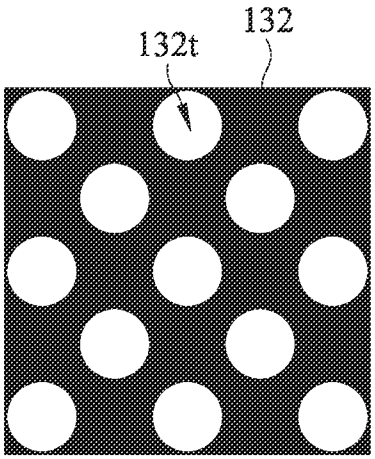
FIG. 5 is a schematic top view of a visible light absorbing pattern according to an embodiment of the present invention.
Figure 4:
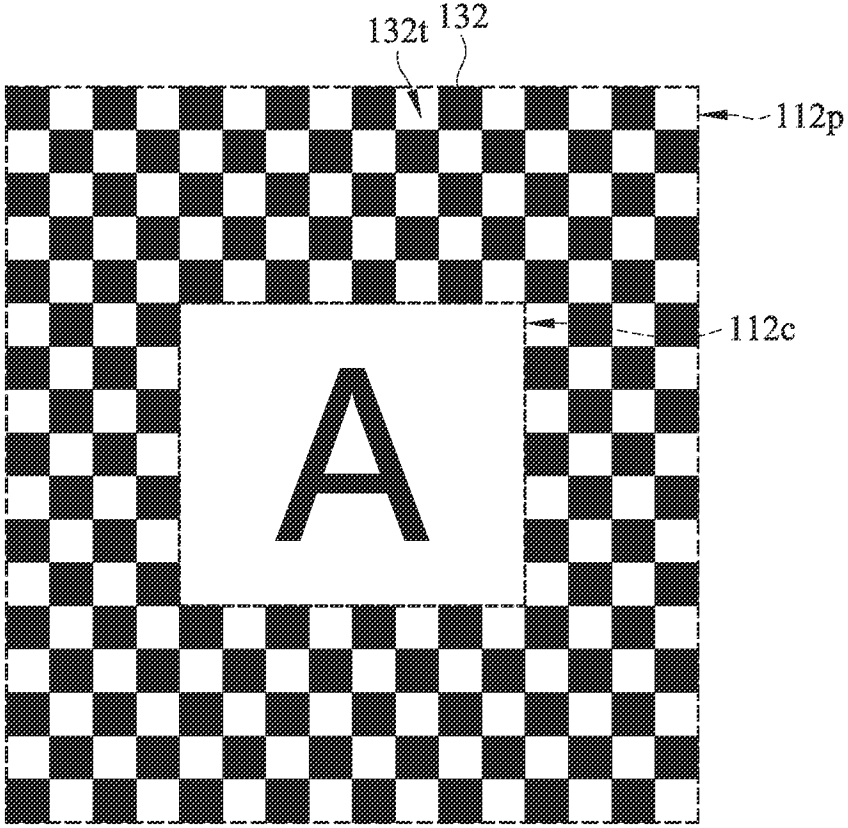
FIG. 4 is a schematic top view of a visible light absorbing pattern according to an embodiment of the present invention.
Figure 7:
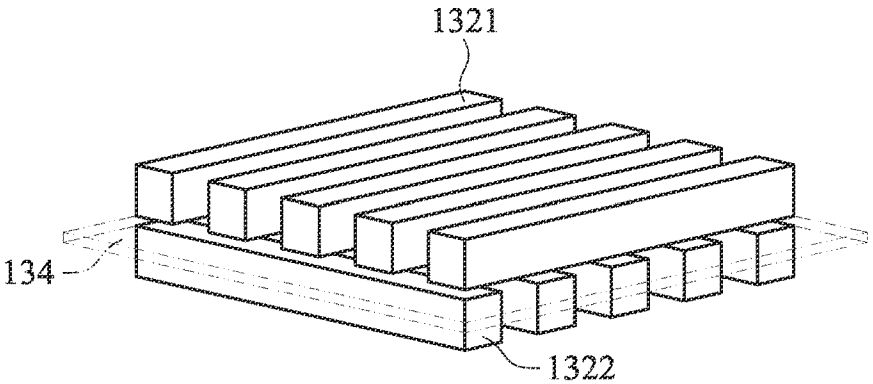
FIG. 7 is a schematic perspective view of a light adjusting structure according to an embodiment of the present invention.
Figure 6:
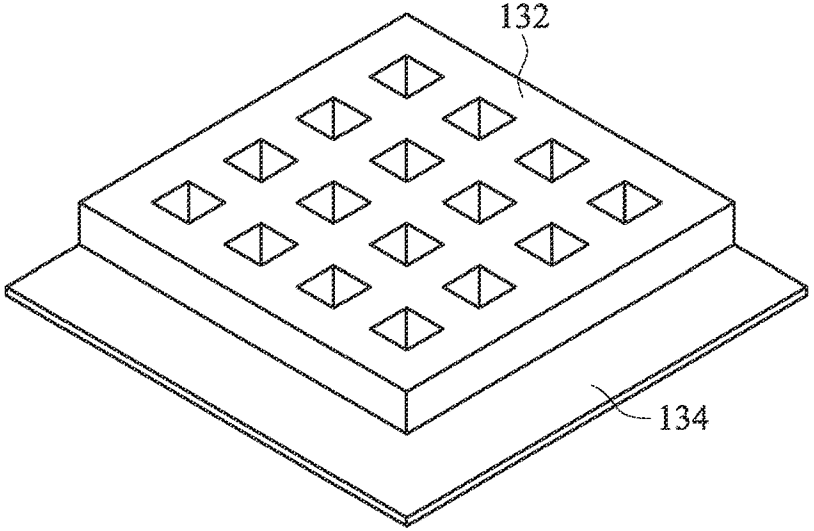
FIG. 6 is a schematic perspective view of a light adjusting structure according to an embodiment of the present invention.

The vertical projection of the visible light absorbing pattern 132 presents a checkerboard pattern or a mesh pattern, and various embodiments are provided below. FIG. 4 is a schematic top view of a visible light absorbing pattern according to an embodiment of the present invention. FIG. 5 is a schematic top view of a visible light absorbing pattern according to an embodiment of the present invention. FIG. 6 is a schematic perspective view of a light adjusting structure according to an embodiment of the present invention. FIG. 7 is a schematic perspective view of a light adjusting structure according to an embodiment of the present invention.

As shown in FIG. 4, the visible light absorbing pattern 132 and its vertical projection present a checkerboard-like pattern, and each of the light-transmitting regions 132*t* is in a polygonal shape, such as a square shape. In some embodiments, the keycap (e.g., the keycap 112 shown in FIG. 1) has a character region 112*c* and a peripheral region 112*p* outside the character region 112*c*, and the vertical projection of the visible light absorbing pattern 132 is overlapped with a vertical projection of the peripheral region 112*p* and is not overlapped with a vertical projection of the character region 112*c*.

As shown in FIG. 5, the visible light absorbing pattern 132 and its vertical projection present a mesh pattern, and each of the light-transmitting regions 132*t* is circular.

As shown in FIG. 6, the visible light absorbing pattern 132 is disposed on the upper surface of the substrate 134, and the visible light absorbing pattern 132 and its vertical projection present a mesh pattern, and each of the light-transmitting regions (not marked) is in a polygonal shape, such as a square shape.

As shown in FIG. 7, the visible light absorbing pattern 132 is two visible light absorbing patterns 1321 and 1322, which are respectively disposed on the upper surface and the lower surface of the substrate 134. Each of the two visible light absorbing patterns 1321 and 1322 has a plurality of stripe patterns that are substantially parallel to each other. The vertical projections of the two visible light absorbing patterns 1321 and 1322 present a mesh pattern, and each of the light-transmitting regions is in a polygonal shape, such as a square shape.

As can be seen from the above, the present invention reduces the light exit angle and light exit dimension by arranging the visible light absorbing pattern vertically projected as the checkerboard pattern or the mesh pattern at an appropriate position to reduce the light intensity after the light passes through the visible light absorbing pattern, and thus to effectively avoid the strong light leakage around the keycap. Therefore, the user will not see the strong light leakage and its projection regardless of whether the keyboard device is viewed from a top or side view angle.

In addition, as described in the prior art, the light leakage or interference of lights of different colors may occur on other electronic devices. The light adjusting structure including the visible light absorbing pattern of the present disclosure can be applied to other electronic devices to limit the light exit angle of the light source, thereby effectively solving the aforementioned issues. Various embodiments of different electronic devices are provided below.

Figure 8:
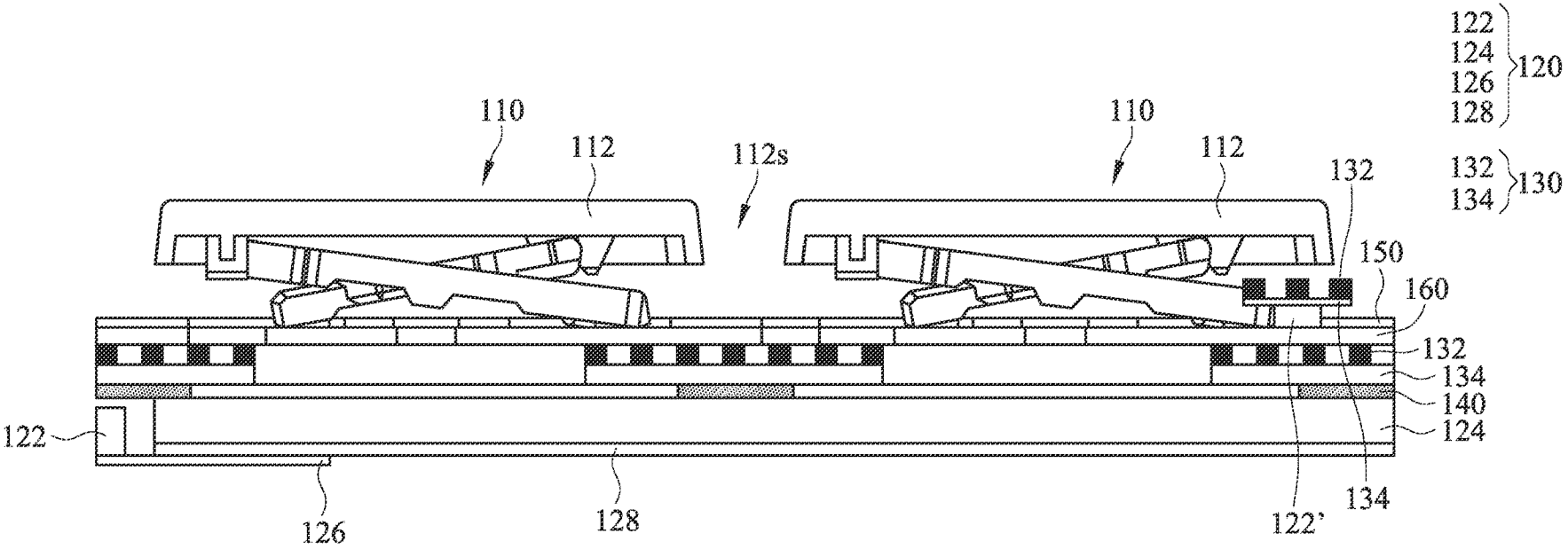
FIG. 8 is a schematic cross-sectional view of a keyboard device according to an embodiment of the present invention.

FIG. 8 is a schematic cross-sectional view of a keyboard device according to an embodiment of the present invention. As shown in FIG. 8, the light source is, for example, a lamp bead 122'. The base plate 160 is disposed beneath the keycaps 112. The lamp bead 122' is disposed on the base plate 160. The light adjusting structure 130 including the visible light absorbing pattern 132 is disposed on the lamp bead 122', and is disposed between the light source (i.e., the lamp bead 122') in the keyboard device and a light exiting surface of the keyboard device (i.e., an upper surface of the keycap 112). As such, strong light leakage from an edge of the keycap 112 corresponding to the lamp bead 122' can be avoided.

Figure 9:
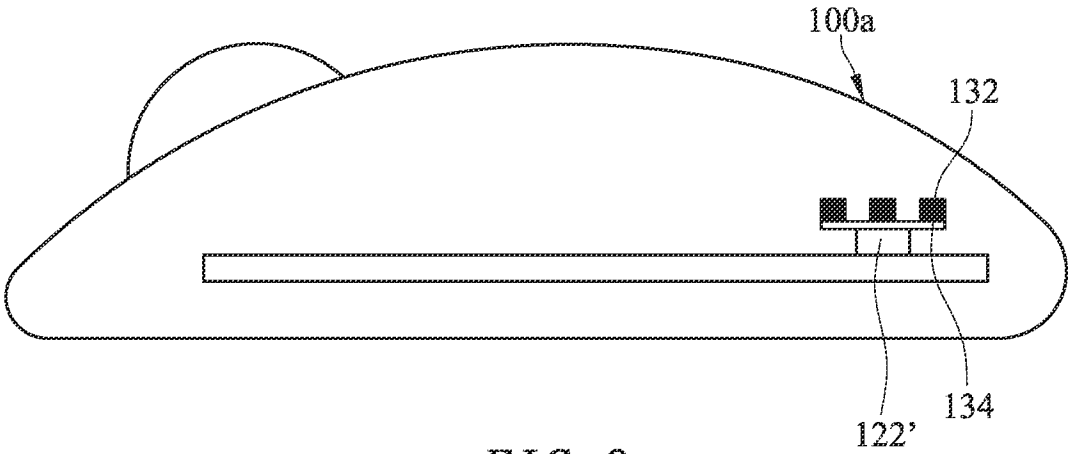
FIG. 9 is a schematic cross-sectional view of a mouse according to an embodiment of the present invention.

FIG. 9 is a schematic cross-sectional view of a mouse according to an embodiment of the present invention. As shown in FIG. 9, the light source is, for example, a lamp bead 122'. The light adjusting structure including the visible light absorbing pattern 132 is disposed on the lamp bead 122 and is disposed between the light source (i.e., the lamp bead 122') in the mouse and a light exiting surface 100*a* of the mouse (i.e., an upper surface of the mouse, for example, a region where a logo is displayed). Since the visible light absorbing pattern 132 can limit the light exit angle, the user will not see light leakage through a gap of the mouse.

Figure 10:
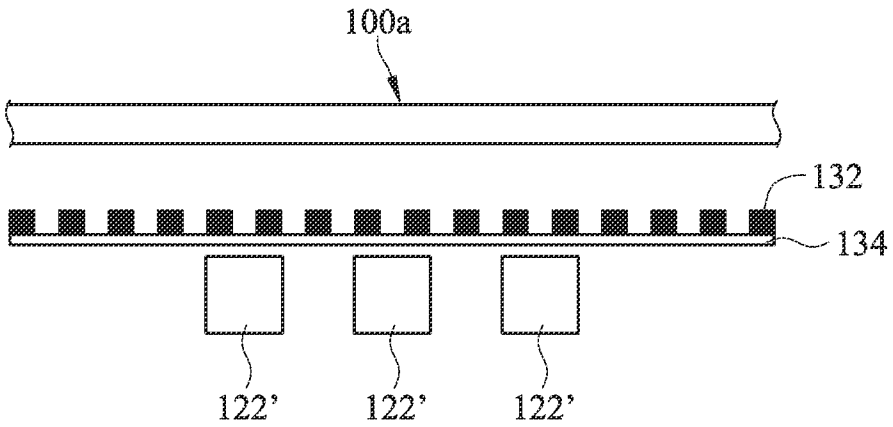
FIG. 10 is a schematic cross-sectional view of an indicator light device according to an embodiment of the present invention.

FIG. 10 is a schematic cross-sectional view of an indicator light device according to an embodiment of the present invention. As shown in FIG. 10, the light source is, for example, a plurality of lamp beads 122' that emit lights of different colors. The light adjusting structure including the visible light absorbing pattern 132 is disposed on the lamp beads 122', and is disposed between the light source (i.e., the lamp bead 122') in the indicator light device and a light exiting surface 100*a* of the indicator light device. Since the visible light absorbing pattern 132 can limit the light exit angles of the lights of different colors, the lights of different colors will not interfere with each other.

From the above, it can be seen that the combination of the light source and the visible light absorbing pattern 132 can effectively limit the light exit angle of the light source, so it can solve the issues of the light leakage or interference of lights of different colors in the general electronic devices.

However, the above are only the preferred embodiments of the present disclosure, and should not be used to limit the scope of implementation of the present disclosure, that is, simple equivalent changes and modifications made in accordance with claims and description of the present disclosure are still within the scope of the present disclosure. In addition, any embodiment of the present disclosure or claim does not need to achieve all the objectives or advantages disclosed in the present disclosure. In addition, the abstract and the title are not used to limit the scope of claims of the present disclosure.

What is claimed is:

1. A device, comprising:

a light source; and a light adjusting structure, disposed between the light source and a light exiting surface of the device, the light adjusting structure comprising:

at least one visible light absorbing pattern, defining a plurality of light-transmitting regions, wherein a ratio of a thickness of the at least one visible light absorbing pattern to a width of one of the light-transmitting regions is greater than or equal to 0.5, and a vertical projection of the at least one visible light absorbing pattern presents a checkerboard pattern or a mesh pattern, and the width of the one of the light-transmitting regions is between 5 microns and 1,000 microns, and the light source is aligned with a portion of the at least one visible light absorbing pattern and some of the light-transmitting regions defined by the portion of the at least one visible light absorbing pattern.

2. The device of claim 1, wherein the thickness of the at least one visible light absorbing pattern is between 5 microns and 1,000 microns.

3. A keyboard device, comprising:

a plurality of keycaps;

a light source, disposed beneath the keycaps; and a light adjusting structure, disposed between the light source and at least one of the keycaps, wherein the light adjusting structure includes at least one visible light absorbing pattern disposed between the light source and the at least one of the keycaps and defining a plurality of light-transmitting regions, and a ratio of a thickness of the at least one visible light absorbing pattern to a width of one of the light-transmitting regions is greater than or equal to 0.5, and a vertical projection of the at least one visible light absorbing pattern presents a checkerboard pattern or a mesh pattern, and the width of the one of the light-transmitting regions is between 5 microns and 1,000 microns, and a portion of the at least one of the keycaps is aligned with a portion of the at least one visible light absorbing pattern and some of the light-transmitting regions defined by the portion of the at least one visible light absorbing pattern.

4. The keyboard device of claim 3, wherein there is a gap between adjacent two of the keycaps, and the vertical projection of the at least one visible light absorbing pattern and vertical projections of the light-transmitting regions defined by the at least one visible light absorbing pattern are overlapped with a vertical projection of the gap.

5. The keyboard device of claim 3, wherein the at least one of the keycaps has a character region and a peripheral region outside the character region, and the vertical projection of the at least one visible light absorbing pattern and vertical projections of the light-transmitting regions defined by the at least one visible light absorbing pattern are overlapped with a vertical projection of the peripheral region and are not overlapped with a vertical projection of the character region.

6. The keyboard device of claim 3, wherein each of the light-transmitting regions is polygonal or circular.

7. The keyboard device of claim 3, wherein the ratio is greater than or equal to 1.

8. The keyboard device of claim 3, wherein the light adjusting structure further comprises a substrate, and the at least one visible light absorbing pattern is disposed on an upper surface or a lower surface of the substrate.

9. The keyboard device of claim 3, wherein the thickness of the at least one visible light absorbing pattern is between 5 microns and 1,000 microns.

10. The keyboard device of claim 3, wherein the light adjusting structure further comprises a substrate, and the at least one visible light absorbing pattern is two visible light absorbing patterns respectively disposed on an upper surface and a lower surface of the substrate.

11. The keyboard device of claim 10, wherein each of the two visible light absorbing patterns comprises a plurality of strip patterns, and the two vertical projections of the two visible light absorbing patterns present the mesh pattern.

12. The keyboard device of claim 3, wherein the light source is a backlight module or at least one lamp bead.

13. The keyboard device of claim 12, wherein the light source is the backlight module comprising a lamp bead and a light guide plate laterally adjacent to the lamp bead, and the light adjusting structure is disposed on the lamp bead and/or the light guide plate.

14. The keyboard device as claimed in claim 12, wherein the light source is the backlight module, and the keyboard device further comprises:

a light-shielding layer, disposed between the keycaps and the light adjusting structure, or disposed between the light adjusting structure and the backlight module.

15. The keyboard device of claim 12, wherein the light source is the at least one lamp bead, and the keyboard device further comprises:

a base plate, disposed beneath the keycaps, wherein the at least one lamp bead is disposed on the base plate, and the light adjusting structure is disposed on the at least one lamp bead.

* * * * *